US006722655B1

(12) United States Patent
Camero

(10) Patent No.: US 6,722,655 B1
(45) Date of Patent: Apr. 20, 2004

(54) CARD GAME COMBINING POKER AND BINGO CONCEPTS

(76) Inventor: Royal D. Camero, 1852 Bannister Rd., Anchorage, AK (US) 99508

( * ) Notice: Subject to any disclaimer, the term of this patent is extended or adjusted under 35 U.S.C. 154(b) by 0 days.

(21) Appl. No.: 10/306,425

(22) Filed: Nov. 27, 2002

(51) Int. Cl.[7] ..... A63F 3/06
(52) U.S. Cl. ..... 273/269; 273/274; 273/292
(58) Field of Search ..... 273/269, 274, 273/292; 463/12, 13

(56) References Cited

U.S. PATENT DOCUMENTS

| | | | | | |
|---|---|---|---|---|---|
| 3,899,176 | A | * | 8/1975 | Gregan | 273/287 |
| 4,364,567 | A | * | 12/1982 | Goott | 273/237 |
| 4,560,171 | A | * | 12/1985 | Anthony | 273/269 |
| 4,746,126 | A | * | 5/1988 | Angileri | 273/249 |
| 4,856,787 | A | * | 8/1989 | Itkis | 273/237 |
| 5,046,736 | A | * | 9/1991 | Bridgeman et al. | 463/13 |
| 5,100,139 | A | * | 3/1992 | Di Bella | 273/292 |
| 5,377,992 | A | * | 1/1995 | Audet | 273/271 |
| 5,393,057 | A | * | 2/1995 | Marnell, II | 463/13 |
| 5,482,289 | A | * | 1/1996 | Weingardt | 273/269 |
| 5,486,005 | A | * | 1/1996 | Neal | 273/292 |
| 5,569,083 | A | * | 10/1996 | Fioretti | 463/19 |
| 5,727,786 | A | * | 3/1998 | Weingardt | 273/269 |
| 5,791,649 | A | * | 8/1998 | DiSandro | 273/243 |
| 5,806,855 | A | * | 9/1998 | Cherry | 273/292 |
| 5,816,577 | A | * | 10/1998 | Preston et al. | 273/292 |
| 6,079,711 | A | * | 6/2000 | Wei et al. | 273/269 |
| 6,174,235 | B1 | * | 1/2001 | Walker et al. | 463/25 |
| 6,234,483 | B1 | * | 5/2001 | Bucan | 273/292 |
| 6,368,214 | B1 | * | 4/2002 | Luciano | 463/18 |
| 6,382,629 | B1 | * | 5/2002 | Hill | 273/303 |
| 6,398,645 | B1 | * | 6/2002 | Yoseloff | 463/19 |
| 6,409,173 | B1 | * | 6/2002 | Tri | 273/292 |
| 6,454,266 | B1 | * | 9/2002 | Breeding et al. | 273/292 |
| 6,511,072 | B1 | * | 1/2003 | Santa Cruz et al. | 273/292 |
| 6,565,091 | B2 | * | 5/2003 | Weingardt | 273/269 |
| 2002/0113369 | A1 | * | 8/2002 | Weingardt | 273/269 |
| 2002/0117803 | A1 | * | 8/2002 | Weingardt | 273/269 |

* cited by examiner

*Primary Examiner*—Benjamin H. Layno
*Assistant Examiner*—Dolores R Collins

(57) ABSTRACT

A game that combines the concepts of poker and bingo is disclosed. The game is comprised of as many as thirteen individual player-tablets, a game board, a deck of standard playing cards, chips for establishing pots, and tokens for covering indicia cards on the player-tablets. Up to thirteen individual player-tablets can be used in a single game, with each sheet having a unique indicia of twenty-five different playing cards, including one Joker, imprinted on it and arranged strategically in a 5×5 matrix so that no two player-tablets in a given game are the same. The main game board is laid out with five pot areas comprised of a Center Pot, a Four-Corners Pot, a Four-of-a-Kind Pot, a Bingo Pot, and a Jackpot. When one of the pot conditions is covered on a player-tablet, the player wins that pot. Each time the Bingo Pot is won, the present game is over, with all pots that were not won remaining on the game board. Bets are then made again by placing chips in all the pots and another game is played. This allows some of the pots to build up to large amounts. All the chips remaining in pots that are not won after a predetermined number of games are moved to the Jackpot and a final Jackpot game is played where the first player to cover all twenty five cards, except the Joker, on his/her player-tablet wins the Jackpot.

20 Claims, 3 Drawing Sheets

CARD GAME COMBINING POKER AND BINGO CONCEPTS

BACKGROUND OF THE INVENTION

1. Field of the Invention

The present invention relates to a card game for use in connection with entertaining family and friends. The poker-bingo game has particular utility in connection with combining many of the features of two well-known games, poker and bingo, into a single entertaining new game.

2. Description of the Prior Art

Bingo and poker are two popular games that have stood the test of time. Each of these games provides their own form of entertainment, excitement, and suspense to the players. It seems that it would be desirable to combine the major concepts and features of the two games to provide a new game with its own unique features derived from these well-known games.

Card games of this type are known in the prior art. For example, U.S. Pat. No. 6,079,711 to Wei et al. discloses a combination bingo and poker game, which uses a game board similar to that used in bingo. However, the Wei '711 patent is different in structure from the present invention, does not draw standard playing cards to advance the game, and has the further drawback of requiring a winning bingo configuration before any of the poker hands come into play.

U.S. Pat. No. 3,649,023 to Schohn discloses a method of playing a parlor game where cards cover playing board sections. However, the Schohn '023 patent involves a different method and the playing board has a different structure from that of the present inventions.

U.S. Pat. No. 1,723,377 to Salomon discloses a combination poker and bingo-like game, which uses playing cards and game boards, which have fixed poker-type combination of cards arranged in rows and columns. However, the Solomon '377 patent uses both a different method and playing board structure from that of the present invention.

Also, U.S. Pat. No. 5,029,871 to Wilson et al. discloses a sequence board game that uses playing cards. However, the Wilson '871 patent is closer related to the game of bingo, does not combine features from the game of poker, and further the playing board has a different structure form that of the present invention.

Similarly, U.S. Pat. No. 5,377,992 to Audet discloses a method of playing a board game utilizing playing cards and tokens. However, the Audet '992 patent uses a different method and playing board from that of the present invention.

Lastly, U.S. Des. Pat. No. 161,352 to Madieu discloses the design of a game board that may be of general interest and pertinent to the construction and design of the present invention. However, the playing board of the Madieu '352 patent has a different structure from that of the present invention.

While the above-described games fulfill their respective, particular objectives and requirements, the aforementioned patents do not describe a game that combines concepts of bingo and poker in the method of the present invention, nor do they utilize a game board of player-tablets having the structure of the present invention.

Therefore, a need exists for a new and improved card game that can be used for family entertainment that combines aspects of both poker and bingo in a unique way. In this regard, the present invention substantially fulfills this need. In this respect, the poker-bingo game according to the present invention substantially departs from the conventional concepts and designs of the prior art, and in doing so provides a game primarily developed for the purpose of entertaining family and friends.

SUMMARY OF THE INVENTION

In view of the foregoing disadvantages inherent in the known types of bingo-poker combination games now present in the prior art, the present invention provides an improved poker-bingo game, and overcomes the above-mentioned disadvantages and drawbacks of the prior art. As such, the general purpose of the present invention, which will be described subsequently in greater detail, is to provide a new and improved game board structure and method that has all the advantages of the prior art mentioned heretofore and many novel features that result in a bingo poker game that is not anticipated, rendered obvious, suggested, or even implied by the prior art, either alone or in any combination thereof.

The poker-bingo game of the present invention is a game that combines the concepts of poker and bingo. To attain this, the present invention essentially comprises individual player-tablets, a game board, a deck of standard playing cards, some poker chips, and some cover tokens. Up to thirteen individual player-tablets can be used in a single game, with each tablet having a unique indicia of twenty five playing cards imprinted on it and arranged strategically in a 5×5 matrix so that no two player-tablets are the same. The game board is laid out with five pot areas comprised of a Center Pot, a Four-Corners Pot, a Four-of-a-Kind Pot, a Bingo Pot, and a Jackpot. The pot amounts are agreed on before the game with each player placing the appropriated number of chips on the pot areas of the game board. The pots do not have to have monetary value, therefore making this a family oriented game for all ages.

The rules define the winner(s) of the five pots as follows:

(1) The Center Pot is won by the first player whose card at the center of his/her player-tablet matches the card drawn from the deck of playing cards.

(2) The Four-Comers Pot is won by the first player(s) whose cards on the four corners of his/her player-tablet matches cards drawn from the deck of playing cards. It is possible to have more than one winner of this pot, in which case the pot is divided among the winners.

(3) The Four-of-a-Kind Pot is won by the player whose card from each of the four suites on his/her player-tablet matches cards drawn from the deck of playing cards.

(4) The Bingo Pot is won by the player(s) who has five consecutive cards in horizontal, vertical, or diagonal row on his/her player-tablet matching cards drawn from the deck of playing cards. Here again, it is possible to have more than one winner of this pot, in which case the pot is divided among the winners.

(5) The Jackpot is a special pot that can be defined in different ways. The pot is won by the first player to have all 25 of his/her player-tablet cards matching cards drawn from the deck of playing cards. However, the Jackpot is played only after one of the other three pots (excluding the Bingo Pot) has not been won in a predetermined number of games, in which case these pots that have not been won are moved to the Jackpot and the game is played for this large pot.

A game is declared over when someone wins the Bingo Pot, even if the other pots have been won. A new game will then be played by placing new bets on all pots, except the Jackpot. This allows for various pots to build up to sizable amounts, thereby increases interest and excitement in the game. This invention relates to a family game that can be played by as many as thirteen players of any age. The main objective of the invention is to provide entertainment and increasing excitement to the players as the game progresses. Although the game basically does not require a strategy to win, the combined excitement and suspense that is inherent in a both a bingo game and a poker game are combined to make this game unique.

There has thus been outlined, rather broadly, the more important features of the invention in order that the detailed description thereof that follows may be better understood and in order that the present contribution to the art may be better appreciated.

There are, of course, additional features of the game that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new poker-bingo game that provides in the apparatuses and methods of the prior art some of the advantages thereof, while simultaneously overcoming some of the disadvantages normally associated therewith.

It is also an object of the present invention to provide a new and improved game board and individual player-tablets, which is unique in structure.

It is another object of the present invention to provide a new and improved poker-bingo game that may be easily and efficiently manufactured and marketed.

An even further object of the present invention is to provide a new and improved poker-bingo game that has a low cost of manufacture with regard to both materials and labor, and which accordingly is then susceptible of low prices of sale to the consuming public, thereby making such games economically available to the buying public.

Lastly, it is an object of the present invention to provide a new and improved method or set of rules for the game that provides multiple ways of winning and allows pots to build up to sizable amounts, thereby increasing the interest of more players in the game.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
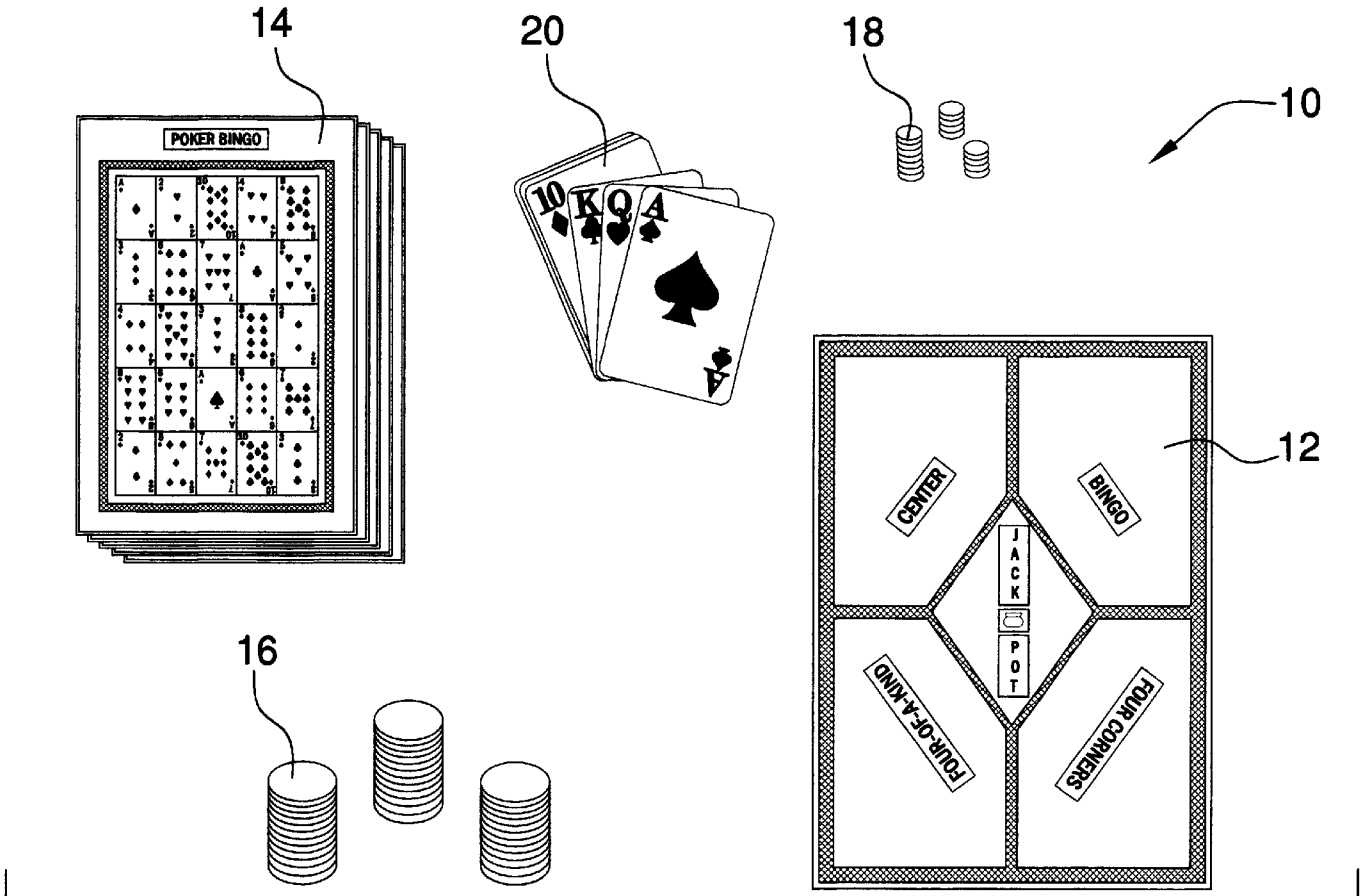
FIG. 1 is a drawing showing the items included in the poker-bingo game kit of the present invention.
Figure 2:
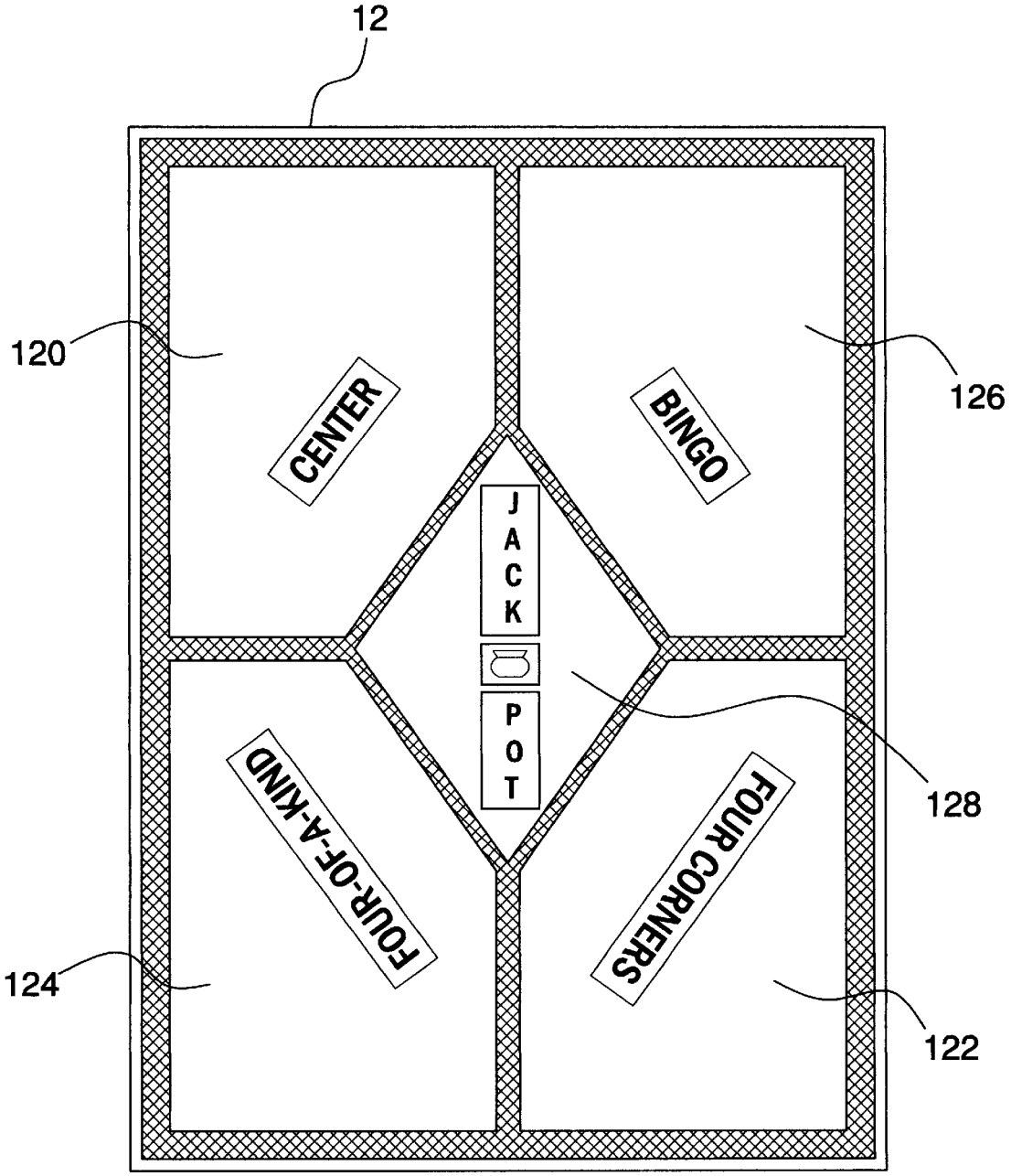
FIG. 2 is a drawing showing the game board of the preferred embodiment of the poker-bingo game, constructed in accordance with the principles of the present invention.
Figure 3:
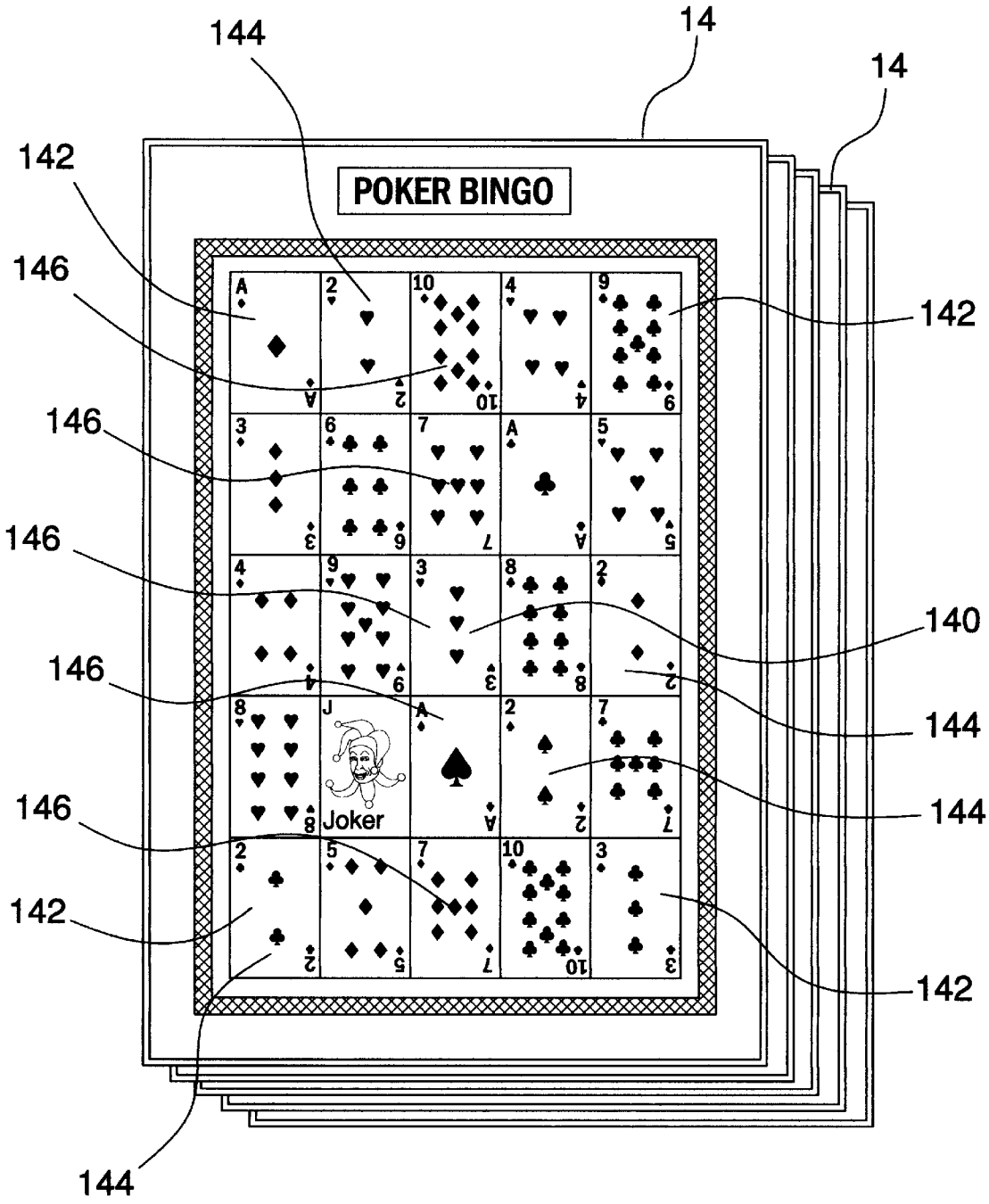
FIG. 3 is a drawing showing the layout of the individual player-tablets use in the poker-bingo game of the present invention.

Referring now to the drawings, and particularly to FIGS. 1–3, a preferred embodiment of the poker-bingo game of the present invention is shown and generally designated by the reference numeral 10.

In FIG. 1, a kit 10 for the new and improved poker-bingo game of the present invention is illustrated and will be described. More particularly, the kit 10 is comprised of a game board 12, thirteen player-tablets 14, poker-like chips for use in funding the pots, cover tokens 18 for covering spaces on the player-tablets, and a standard deck of playing cards 20. In addition, the kit has an instruction card, which gives the rules of the game, and a box for storing the components (not shown).

FIG. 2 is a drawing showing the game board 12 of the preferred embodiment of the poker-bingo game, constructed in accordance with the principles of the present invention. The game board 12 is at least 8 ½-inches wide by 11-inches long and is laid out with a Jackpot 128 in the middle and surrounded by a Center Pot 120, a Four-Corners Pot 122, a Four-of-a-Kind Pot 124, and a Bingo Pot 126 located in the corners of the board around the Jackpot area. The game board 12 is constructed out of cardboard, plastic, wood, or other solid board material.

FIG. 3 is a drawing showing the layout of the individual player-tablets 14 used in the poker-bingo game of the present invention. The player-tablet 14 is comprised of printed indicia representing twenty-five playing cards arranged in a 5×5 matrix (5 rows by 5 columns). From two to thirteen (maximum of thirteen players) of these player-tablets can be used in a game. When a card is drawn from the deck of cards 20 that matches one of the indicia cards on a player-tablet, then a cover token 18 is used to cover that position on the player-tablet 14. There are a number of combinations on these cards that can win one of the pots on the game board 12. These combinations include a center card 140, four-corners cards 142, four-of-a-kind cards 144 (example, 2 of hearts, diamonds, spades, and clubs), and bingo cards 146 (five consecutive cards in a vertical 144, horizontal, or diagonal row). One joker card is included on each player-tablet that can be used in forming a bingo condition, however it cannot be used with a four-of-a-kind card to form a bingo condition.

In use, it can now be understood that while the poker-bingo game can be played with up to thirteen players or a maximum of thirteen player-tablets 14. None of the player-tablets 14 have the same cards or arrangement of cards. Also, one of the players will be designated as the dealer who will shuffle the deck of playing cards 20 before each game starts. The dealer then draws cards one at a time with the deck turned face down, starting with the top card. Usually, the dealer will rotate consecutively between the players.

House rules are generally set before the game starts, establishing the amount of the pots, or for example, if a player(s) fails to cover a card(s) at the time it was drawn, he/she cannot cover the card(s) later. Also, if a player(s) quits during the game, he/she forfeits their bets already in the pots, or if a new player(s) wishes to enter the game he/she is required to place an equal amount of bets in the existing pots on the game board 12.

How to play:

1. Pick one or more of your favorite player-tablets 14, at least twenty-five cover tokens 18, and some poker chips 16 or pennies to place your bets in the game board pots.
2. Start the game by placing your bets (chips) in each pot.
3. Cover only the spaces on the player-tablet that matches the cards drawn by the dealer.

How to win the game:

1. Center Pot 120—This pot is won by the first person whose middle space card 140 on the player-tablet 14 matches a card drawn from the deck of cards. There can only be one winner of this pot per game.
2. Four-Corners Pot 122—This pot is won if all four corner cards 142 on a player-tablet match cards drawn from the deck of cards. There can be more than one winner of this pot, in which case all winners split the pot.
3. Four-of-a-Kind Pot 124—This pot is won by the player who covers all of his/her four-of-a-kind card suite 144 by matching cards drawn from the deck of cards. Before the game, each player determines his/her four-of-a-kind card suite 144. Each player has a different suite, so there can only be one winner of this pot, the player who covers all of four-of-a-kind cards first.
4. Bingo Pot 126—This pot is won by the first player who covers five consecutive cards in a row in either horizontal, vertical 146 or diagonal direction by matching the cards drawn from the deck of cards. Each of the player-tablets 14 has a Joker (wild card) that can be used as the fifth card in forming a bingo. However, the Joker card cannot be used with the four-of-a-kind cards to form a bingo. Again, there can be more than one winner of this pot, in which case all winners split the pot.
5. Jackpot 128—To win the Jackpot, a player must cover all the cards on the player-tablet 14, except the Joker. A special set of rules applies to the Jackpot game. Jackpot is played only under certain situations that may occur during the progress of a game, such as if one or more of the other four pots has not been won after a predetermined number of games. All the chips from these pots are then placed in the Jackpot and a new game is played. In this case, the dealer will reshuffle and continue to draw cards while the players cover every card space on their boards as they are matched. As the game progresses, the excitement builds up, especially to that point when one or more players only have one or two spaces left uncovered on their boards. Consequently, the first player(s) to cover all the spaces on their player-tablets, will win the Jackpot, which is the ultimate goal of the invention.

The fun and excitement of this game depends mostly on the Bingo Pot 126. The main rule of this game requires that if or when this pot is won, the game in progress be over even if some of the pots have not been won. A new game will be started and each player is required to place his or her new bets on each pot. A new dealer will reshuffle the deck of cards and start a new game. Each time the Bingo Pot is won, whether at the early or later stages of the game, the pots that were not won will keep building up, so the players will have a chance for a big win. But there is a limit to the size of the pots; i.e., the rules state that after a predetermined number of consecutive games (example ten), all pots that have not been won, will be collected and placed in the center Jackpot 128 and a Jackpot game will be played.

While a preferred embodiment of the poker-bingo game has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material can be used to construct the game board. Also, other special rules concerning when to play for the Jackpot can be established.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of playing a poker-bingo game, comprising the steps of:

providing individual player-tablets to as many as thirteen players, each player-tablet having a printed indicia of randomly selected playing cards from the four card suites including one Joker, said indicia of random playing cards being arranged in a five by five matrix;

providing poker-style chips to each player;

providing 25 cover tokens to each player;

providing a deck of 52 standard playing cards;

providing a game board, said game board further comprising:

a Jackpot area positioned in the middle of said game board;

a Center Pot area positioned in a first corner of said game board adjacent said Jackpot area;

a Four-Corners Pot area positioned in a second corner of said game board adjacent said Jackpot area;

a Four-of-a-Kind Pot area positioned in a third corner of said game board adjacent said Jackpot area; and a Bingo Pot area positioned in a fourth corner of said game board adjacent said Jackpot area;

informing the players of the house rules for the game, the rules for the five pot categories being defined according to the general rules of poker and bingo;

agreeing on a pot size for each said pot area;

placing said chips in each said pot area on said game board by players;

shuffling said deck of cards by a dealer;

drawing the cards one at a time from the top of said deck by said dealer;

calling out the drawn card by said dealer;

covering of any positions on said player-tablet with said cover token, by said players, that matches said drawn card;

continuing drawing said cards until a player wins said Bingo Pot;

then after a predetermined number of games without one or more of the pots being won, placing all chips from all remaining winless pots in said Jackpot area; and playing a final Jackpot game, according to predetermined Jackpot rules.

2. The method of claim 1, wherein said Jackpot game is won by the first player to have all 25 cards, excluding said Joker, on said player-tablet matching cards drawn from said deck of cards.

3. The method of claim 2, wherein said Jackpot game can be won only after one or more of the other pots have not been won in a predetermined number of games.

4. The method of claim 1, wherein said Center Pot is won by the first player whose player-tablet center position card matches a card drawn from said deck of cards.

5. The method of claim 1, wherein said Four-Corners Pot is split by all players whose four player-tablet corner position cards matches cards drawn from said deck of cards.

6. The method of claim 1, wherein said Four-of-a-Kind Pot is won by the player whose cards from each of the four suites on said player-tablet matches cards drawn from said deck of cards.

7. The method of claim 1, wherein said Bingo Pot is split by the players who have five card positions in a horizontal, vertical, or diagonal row on said player-tablet that matches cards drawn from said deck of cards.

8. The method of claim 1, wherein said game can be played with from two to thirteen players.

9. The method of claim 1, wherein no two player-tablets are the same.

10. The method of claim 1, wherein:

if any player quits during a game, said player's portion of said pots is forfeited; and if new players enter a game in progress, said players are required to place the agreed on amount in the various pots.

11. A kit for a combination poker-bingo game, comprising:

a deck of 52 standard playing cards;

a game board, said game board further comprising:

a Jackpot area positioned in the middle of said game board;

a Center Pot area positioned in a first corner of said game board adjacent said Jackpot area;

a Four-Corners Pot area positioned in a second corner of said game board adjacent said Jackpot area;

a Four-of-a-Kind Pot area positioned in a third corner of said game board adjacent said Jackpot area; and a Bingo Pot area positioned in a fourth corner of said game board adjacent said Jackpot area;

thirteen individual player-tablets, said player-tablets having a printed indicia of randomly selected playing cards from the four card suites including one Joker, said indicia of random playing cards being arranged in a five by five matrix;

a batch of poker-style chips;

325 cover tokens, 25 for each of 13 players;

a game instruction card stating the rules of the game; and a game box for storing the game components.

12. The kit of claim 11, wherein said kit can be used by from two to thirteen players to play a game.

13. The kit of claim 11, wherein no two of said player-tablets are identical.

14. The kit of claim 11, wherein said game board is fabricated from group of materials comprising: cardboard, plastic, and wood.

15. The kit of claim 11, wherein said game board is used to place Jackpot chips, which can be won by the first player to have all 25 player-tablet cards, excluding said Joker, drawn from said deck of cards and covered by said cover tokens on said player-tablets.

16. The kit of claim 11, wherein said game board is used to place said Center Pot chips, which can be won by the first player whose player-tablet center position card is matched by a card drawn from said deck of cards.

17. The kit of claim 11, wherein said game board is used to place said Four-Corners Pot chips, which can be split by all players who have all four player-tablet corner position cards matched by a card drawn from said deck of cards.

18. The kit of claim 11, wherein said game board is used to place said Four-of-a-Kind pot chips, which can be won by the player who has the same card from each of four suites on said player-tablets matched by cards drawn from said deck of cards.

19. The kit of claim 11, wherein said game board is used to place said Bingo Pot chips, which can be split by the players who have five card positions in a horizontal, vertical, or diagonal row on said player-tablet matching cards drawn from said deck of cards.

20. A method of playing a poker-bingo game, comprising the steps of:

providing individual player-tablets to as many as thirteen players, each player-tablet having a printed indicia of randomly selected playing cards from the four card suites including one Joker, said indicia of random playing cards being arranged in a five by five matrix;

providing poker-style chips to each player;

providing at least 25 cover tokens to each player;

providing a deck of 52 standard playing cards;

providing a game board, said game board further comprising:

a Jackpot area positioned in the middle of said board, said Jackpot being won by the first player to have all 25 player-tablet positions, except said Joker, matching cards drawn from said deck of cards, said Jackpot game only being played after one or more of the other pots have not been won in a predetermined number of games;

a Center Pot area positioned in a first corner of said game board adjacent said jack pot area, said Center Pot is won by the first player whose player-tablet center position matches a card drawn from said deck of cards;

a Four-Corners Pot area positioned in a second corner of said game board adjacent said Jackpot area, said Four-Comers Pot is split by all players who have all four player-tablet corner position cards matching cards drawn from said deck of cards;

a Four-of-a-Kind Pot area positioned in a third corner of said game board adjacent said Jack Pot area, said Four-of-a-Kind Pot is won by the player who has the same card from each of the four suites on said player-tablet that matches cards drawn from said deck of cards; and a Bingo Pot area positioned in a fourth corner of said game board adjacent said jack pot area, said Bingo Pot is split by the players who have five card positions in a horizontal, vertical, or diagonal row on said player-tablet that matches cards drawn from said deck of cards;

assuring that every player understands the house rules for the game;

agreeing on a pot size for each said pot area;

placing said chips in each pot area on said game board by players, same said pot amount being added to each pot area by any player entering a game in progress, said pot amounted being forfeited by any player quitting a game in progress;

shuffling said deck of cards by a dealer;

drawing the cards one at a time from the top of said deck by said dealer;

calling out the drawn card by said dealer;

covering of any positions by said players with said cover token on said player-tablet that matches said drawn card;

continuing drawing said cards until a player wins said Bingo Pot;

then after a predetermined number of games without one or more of the pots being won, placing all chips from all remaining winless pots in said Jackpot area; and playing a final Jackpot game, said Jackpot game ending when a player covers all twenty-five cards on his/her player-tablet, except for said Joker, by matching said player-tablet cards with cards drawn form said deck of cards.

* * * * *